US005287995A

United States Patent [19]

Redman et al.

[11] Patent Number: 5,287,995

[45] Date of Patent: Feb. 22, 1994

[54] TEAR GAS DEFENSE SYSTEM

[76] Inventors: Kenneth R. Redman, 918 Parkfield Ter., Ballwin, Mo. 63011; Randall D. Lytle, 15953 Wetherburn, Chesterfield, Mo. 63017

[21] Appl. No.: 865,559

[22] Filed: Apr. 9, 1992

[51] Int. Cl.[5] ..... B65D 83/14

[52] U.S. Cl. ..... 222/175; 222/182; 222/183; 224/242; 224/250

[58] Field of Search ..... 222/175, 182, 183; 224/191, 228, 230, 242, 245, 246, 250, 914

[56] References Cited

U.S. PATENT DOCUMENTS

| | | | |
|---|---|---|---|
| 2,409,987 | 10/1946 | Schroeder et al. | 106/172 |
| 2,699,192 | 1/1955 | Poutinen | 206/38.1 |
| 2,753,094 | 7/1956 | Haney, Jr. | 224/197 |
| 2,812,606 | 11/1957 | Painter | 40/546 |
| 2,940,641 | 6/1960 | Norrish et al. | 222/183 |
| 3,240,397 | 3/1966 | Sagarin | 222/182 |
| 3,286,751 | 11/1966 | Dishart | 206/0.81 |
| 3,445,046 | 5/1969 | Wilson | 222/175 X |
| 3,637,120 | 1/1972 | Clay | 224/246 |
| 4,220,263 | 9/1980 | Caruso | 222/183 |
| 4,301,947 | 11/1981 | Potter | 222/182 |
| 4,454,966 | 6/1984 | Hicks | 222/182 X |
| 4,463,879 | 8/1984 | Des Voignes | 222/175 |
| 4,511,062 | 4/1985 | Wilkerson | 222/175 X |
| 4,588,116 | 5/1986 | Litman | 224/914 X |
| 5,002,214 | 3/1991 | Caranci | 224/228 X |

*Primary Examiner*—Andres Kashnikow
*Assistant Examiner*—Lesley D. Morris
*Attorney, Agent, or Firm*—Richard G. Heywood

[57] ABSTRACT

A personal defense system having a protective spray container with an upper end spray actuator, a dispensing cap constructed and arranged to house the spray actuator and have a fixed relationship with the dispensing nozzle thereof, a holster for the container having an interlocking structure with the dispensing cap to prevent relative rotation, and also including a security system releasably attached to the hoister.

38 Claims, 4 Drawing Sheets

FIG. 6
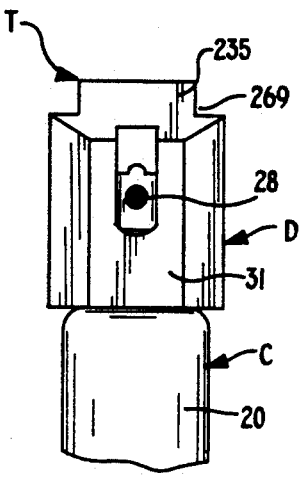
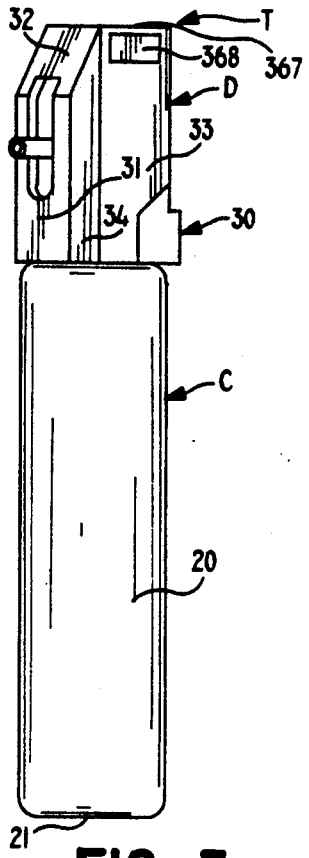
FIG. 7
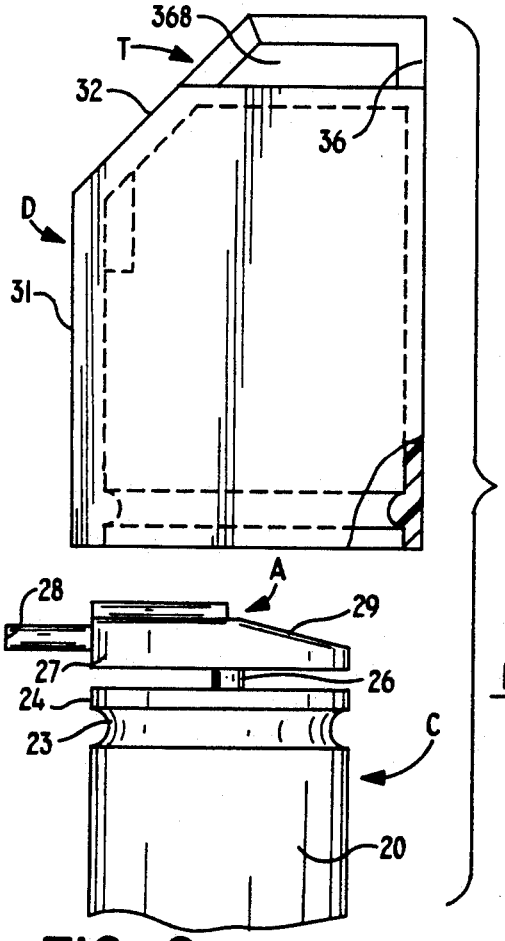
FIG. 9
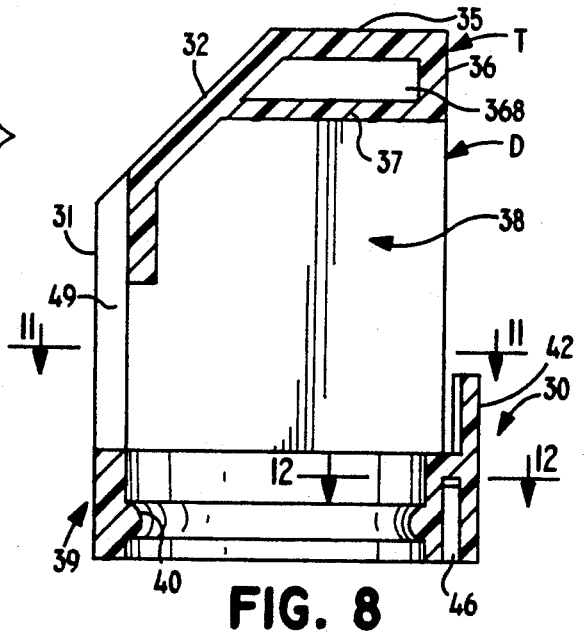
FIG. 8

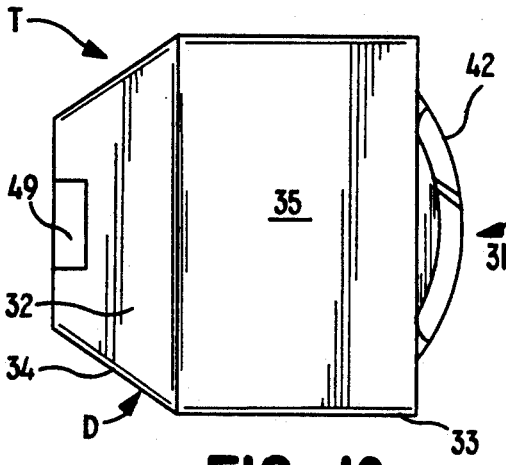
FIG. 10
FIG. 11
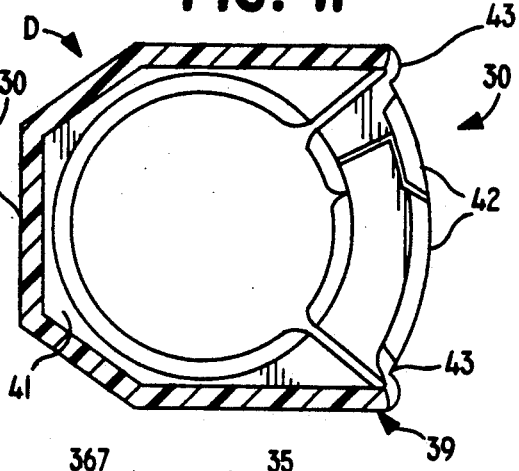
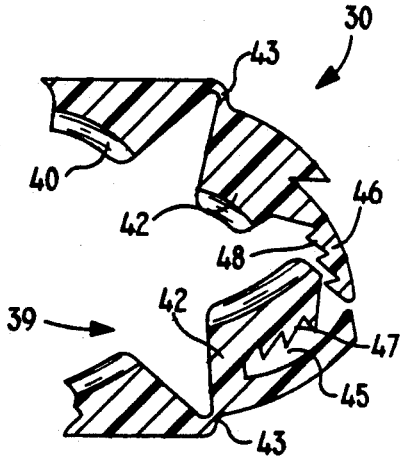
FIG. 12
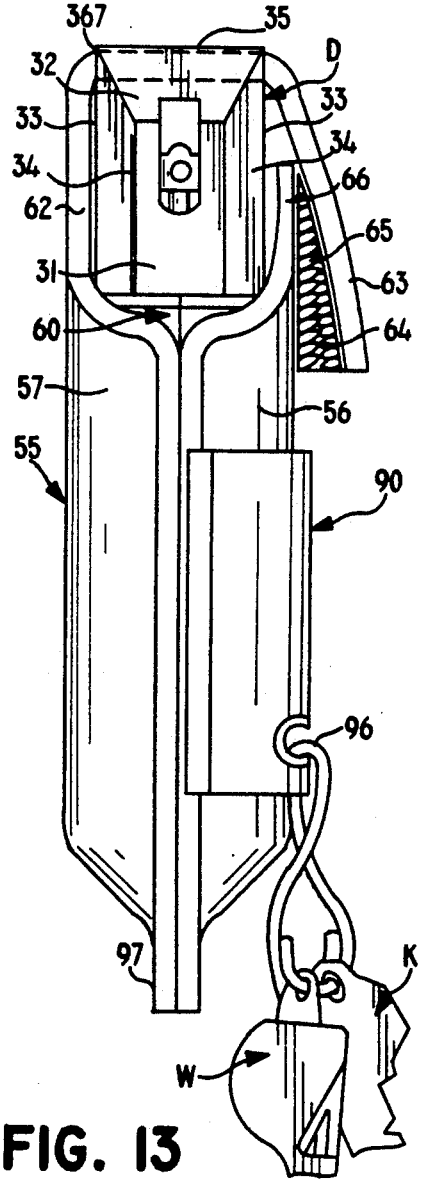
FIG. 13

TEAR GAS DEFENSE SYSTEM

BACKGROUND OF THE INVENTION

1. Field of the Invention

The invention relates generally to spray dispensing canisters, and more particularly to improvements in a jacketed tear gas dispenser and security system for personal defense.

2. Prior Art

In the past, tear gas defense systems have not been either as accepted or as useful as they should be as personal defense weapons even though the term "tear gas" is almost a household word in identifying a substance or product for disabling a potential assailant or attacker, whether human, canine or otherwise. The present invention does not per se relate to any specific tear gas or other disabling formulation or to the construction of the spray canister therefor. However, it is generally known that there are two types of tear gas formulations, called "CN" and "CS", and both types employ active ingredients that effect tear glands and/or breathing and also have other ingredients such as glidants to enable dispensing from aerosol containers as a uniform and controllable spray.

For many years tear gas and like disabling products have been packaged in various forms, including pressurized aerosol canisters, for use by law enforcement officers as a "reasonable force" weapon to subdue or control suspects. This type of weapon in the hands of trained police officials is used as a substitute for guns, nightsticks or billyclubs to prevent unnecessary injuries or even fatalities while serving to immobilize suspects and prisoners. Existing spray canisters are generally designed to fire a series of 20–30 streams or sprays of tear gas fluid up to about 25 feet. Such an ejection as a fluid stream aids in aiming and ensures against "blow back" into the policeman's face.

In recent years, the use of tear gas has been widely advocated as a personal defense weapon. In the personal defense field, the carrying of protective spray devices to ward off or temporarily disable a thief, mugger or other assailant has become more common. It should be recognized that the primary danger time is at night, and generally when moving to or from the car at home, business or the like. However, an attack by a vicious dog or a would-be mugger can occur at any time, and any defense system is only as effective as the preparedness and vigilance of the individual. In the past, tear gas dispensers for personal use, despite information and training, usually become carried haphazardly in a purse or pocket or left lying in a car rather than being kept readily at hand for immediate use if needed. Heretofore, there has been no reliable system encouraging the carrying of the spray canister as a part of defense preparedness in daily living patterns.

Another problem with aerosol canisters in the past has included incidents involving the accidental or inadvertent discharge of the pressurized contents by the pushing or jamming of the actuator member against other small objects or articles, as in a purse, car glove box or the like. In fact, it is a human habit to twist and turn, push and prod and otherwise handle various objects in a purse or pocket, such as keys, change, etc. Prior tear gas canisters have been designed so that such mishandling could result in inadvertent discharge, as aforesaid, or even in a turned misalignment of the spray discharge opening or its valve actuator so that the defense product cannot be fired properly without resetting it.

U.S. Pat. No. 4,220,263 discloses a holstered aerosol container and permanently attached keyring in which the container is free to turn to a blocked position in the holster and is only capable of being actuated by pressing on a retaining strap of the holster. The device of the '263 patent prevents simultaneous use of the protective spray and the keyring. U.S. Pat. No. 3,445,046 shows a holstered aerosol container having a top actuator shielded by the holster, but accessible through a side opening although the container is capable of being turned in the hoister. U.S. Pat. No. 3,240,397 shows a spray dispenser having a guard-type actuator cap, and U.S. Pat. No. 2,940,641 shows a spray dispenser with an outer casing having a telescoping cap actuator.

SUMMARY OF THE INVENTION

The invention is embodied in a personal defense system having a protective spray container with an upper end spray actuator, a dispensing cap constructed and arranged to house the spray actuator and have a fixed relationship with the dispensing nozzle thereof, and a holstering casing for the spray container including locking means for orienting the dispensing cap, and also including other security means releasably attached to the casing.

Even though the specific formulation is not part of the invention, it is an object of the personal defense system to provide a formulation that meets or exceeds all government regulations, i.e. that does not contain any CFC's or other ozone destroying chemicals, is totally biodegradable, non-flammable, and the like.

It is a further object of the present invention to provide a personal defense system including a protective spray and other security and/or signaling means; to provide a system that encourages daily readiness of a personal defense product through usage for ancillary purposes; to provide a system that includes a key holder or other security means that is quickly releasable from a holstered protective spray product; to provide a defense system that includes a protective spray with a discharge opening in fixed orientation with a casing; to provide a defense system that accommodates daily use and immediate preparedness; to provide a system that permits the jacketed protective spray product to function in a dual security mode, and which is positive acting, yet simple and inexpensive. These and other objects and advantages will become more apparent hereinafter.

BRIEF DESCRIPTION OF THE DRAWINGS

In the accompanying drawings which form a part of the specification and wherein like numerals refer to like parts wherever they occur:

FIG. 6 is a fragmentary front elevational view of the second embodiment of FIG. 5;

FIG. 7 is a perspective view showing a third embodiment of the capped spray canister of the present invention;

FIG. 8 is an enlarged cross-sectional view of the canister cap showing in FIG. 7;

FIG. 9 is an enlarged and exploded side elevational view, partly fragmentary, of the spray canister with the modified cap of FIG. 7;

FIG. 10 is an enlarged plan view of the canister cap embodiment of FIG. 7;

FIG. 11 is an enlarged cross-sectional view of the canister cap locking means, as taken substantially along line 11—11 of FIG. 8;

FIG. 12 is an enlarged fragmentary view showing the unlocked condition of the canister cap locking means of FIG. 11, as taken substantially along line 12—12 of FIG. 8;

FIG. 13 is a front elevational view of an assembled personal defense system utilizing the modified capped canister of FIG. 7, and showing a defense stage in action;

DESCRIPTION OF THE PREFERRED EMBODIMENTS

Figure 1:
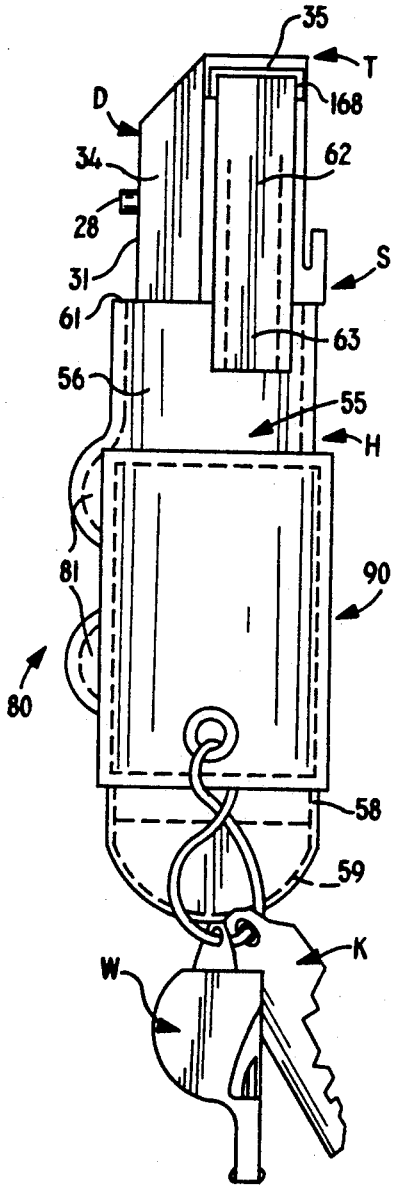
FIG. 1 is a side elevational view of a preferred embodiment of an assembled personal defense system.
Figure 2:
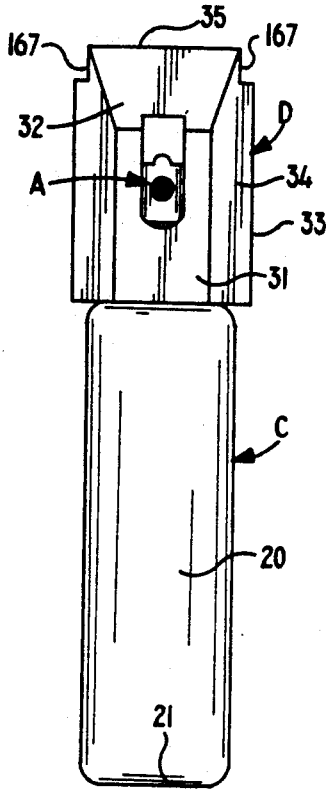
FIG. 2 is a front elevational view of the capped spray canister per se as part of the FIG. 1 embodiment.
Figure 3:
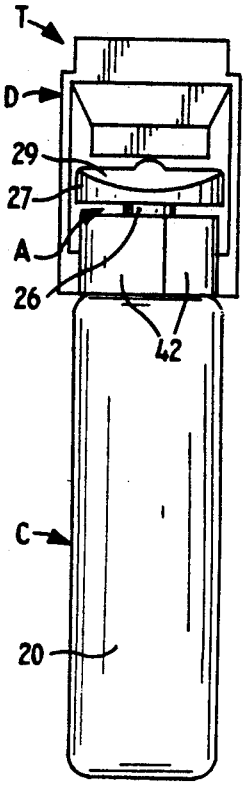
FIG. 3 is a rear elevational view of the capped spray container.
Figure 4:
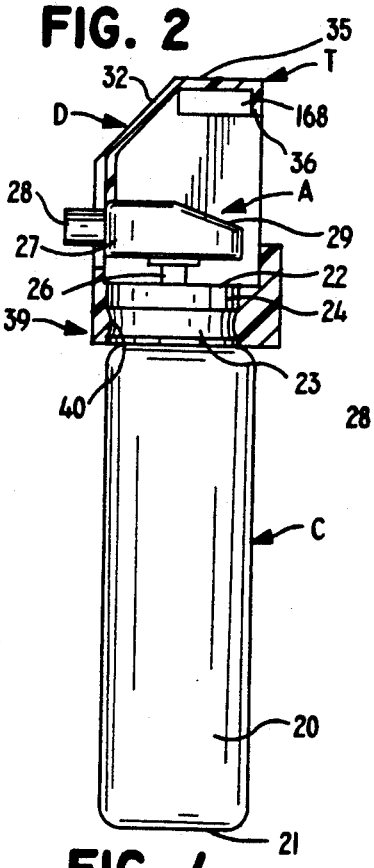
FIG. 4 is a view similar to FIG. 2, but showing the canister cap partly in section.

Referring to the drawings, the personal defense system S of the present invention is embodied in a combination that includes a canister C containing a pressurized (aerosol dispensed) protective spray, such as tear gas, to be manually dispensed by a spray actuator A. The inventive combination is also embodied in a dispensing cap D attached to the canister C and housing the spray actuator A, and in a holstering casing H for the canister and its dispensing cap D, and in other security means releasably associated with the casing H such as a signaling whistle W and key K, as will be described more fully. The container or canister C has a cylindrical body sidewall 20 with a closed bottom 21 and an upper dispensing end 22 having an annular groove 23 adjacent thereto to provide an annular bead or rim 24 at the upper end 22. The spray actuator A has a dispensing valve (not shown) of conventional construction centrally disposed in the canister upper end wall 22, including a valve stem 26 and dispenser body 27 that are internally ported to open the dispensing valve when manually depressed downwardly. The dispenser body 27 has a nozzle 28 connecting with the internal porting for ejecting a spray or stream of the tear gas formulation when the dispenser body 27 is depressed by pushing downwardly the actuator surface 29. As stated, the protective spray formulation, containerization and spray actuator per se will be readily understood by those skilled in the art, and therefore are only generally shown as part of the inventive combination.

Figure 5:
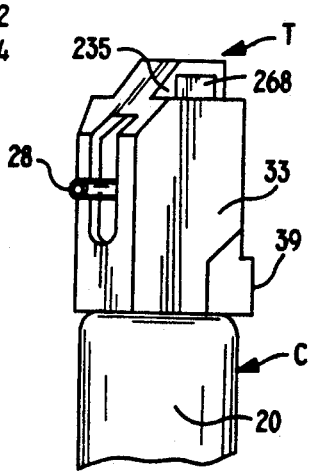
FIG. 5 is a fragmentary perspective view of a second embodiment of the capped spray canister of the present invention.
Figure 14:
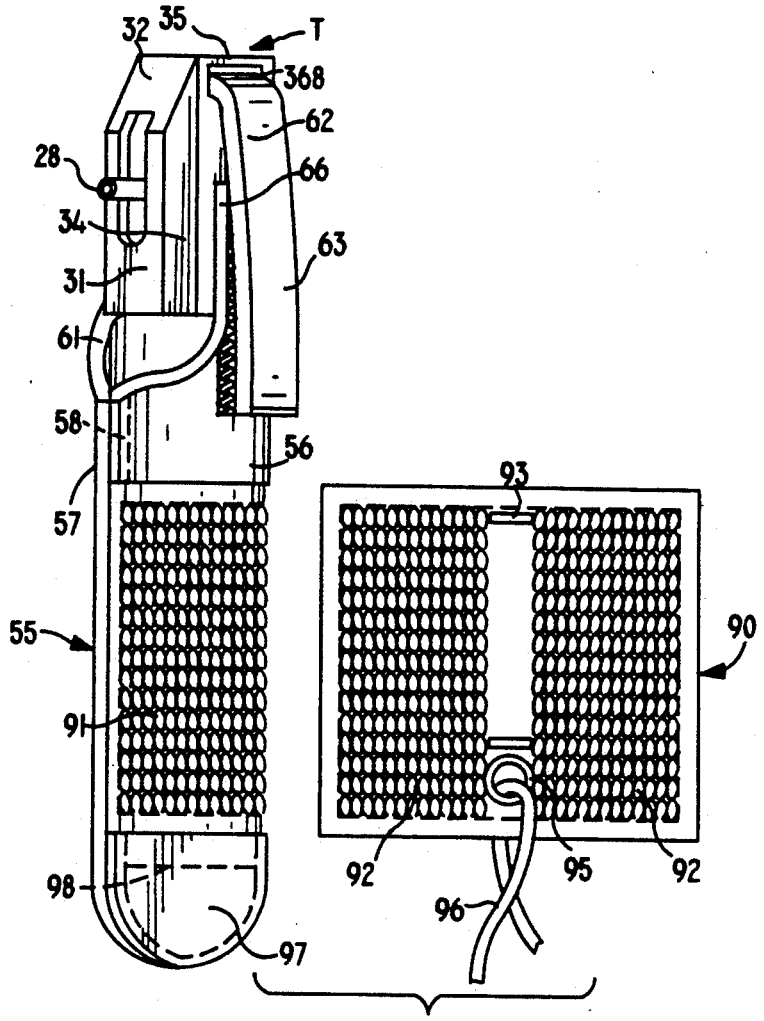
FIG. 14 is a perspective view, partly exploded, further illustrating the invention.
Figure 15:
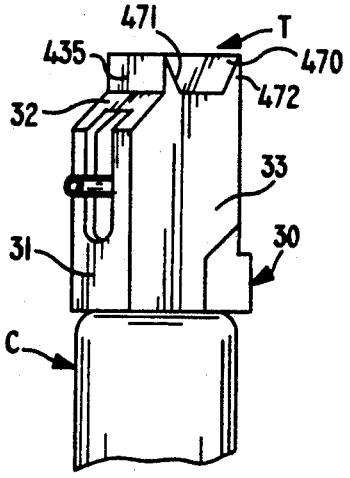
FIG. 15 is a fragmentary perspective view showing a fourth embodiment of the capped spray canister of the invention.
Figure 16:
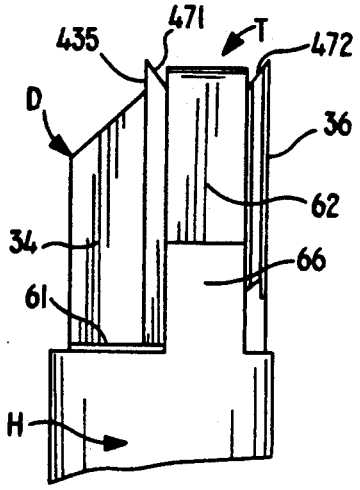
FIG. 16 is a fragmentary side elevational view showing an assembled personal defense system using the capped canister of FIG. 15.

FIGS. 1-4 show the presently preferred embodiment of the invention, FIGS. 5 and 6 show a second embodiment, FIGS. 7-14 show a third embodiment and FIGS. 15 and 16 show a fourth embodiment of the invention. In each of these embodiments the canister C and its spray actuator A is the same, and the dispensing cap D is of similar configuration except as discussed with reference to its interlocking orientation means with the holstering casing H. Accordingly, the same general reference numerals will prevail throughout the different embodiments except where necessary to identify the respective modifications.

Referring first specifically to FIGS. 7-14, wherein the dispensing head or cap D is illustrated in the greatest detail, the cap D has an outer semi-rigid cap body preferably molded of a suitable plastic that will provide some elasticity for assembly of its canister locking assembly 30 onto the canister C to be discussed. The cap body includes a front wall with a lower vertical section 31 (relative to the axis of the canister body 20) and a rearwardly sloping upper section 32, a pair of opposed vertical side walls 33 extending substantially normal to the plane of the lower front wall section 31, vertical corner walls 34 extending diagonally between the front wall sections 31, 32 and the respective side walls 33. The dispensing cap body also includes a substantially horizontally disposed top crown or head cover structure, shown generally at T, bridging across the side walls 33 and rearwardly extending from the upper front wall section 32 to form a canopy or shield over the canister actuator A housed within the cap D. The crown structure T includes an outer or upper top defining wall 35 and a short rear wall 36 extending downwardly from the rear margin of the outer top wall 35, if needed to add strength and rigidity. In the form of FIGS. 7-14, the upper crown T also includes a second lower or inner top wall 37 extending from the lower margin of the rear wall 36 to the front wall section 32 substantially parallel to the upper top wall 35. Thus, it will be clear that the dispensing cap D defines an interior chamber 38 in which the spray actuator A is housed, and the actuator dispenser body 27 is accessible through the open rear side of the cap below the short rear wall 36.

The dispensing cap D is secured on the canister C and to that end the base section 39 of the cap D has an interior bead 40 constructed to have a complementary configuration to the annular groove 23 at the canister upper end 22. As shown best in FIGS. 11 and 12, the base section 39 is made in the form of an open collar having locking assembly or closure locking means 30 for securing the cap D on the canister C. In the preferred form of the base shown best in FIGS. 8-12, an inwardly projecting boss 41 is formed around the front, side and diagonal walls 31, 33, 34 and carries the bead 40 thereon. The rear side of the base 39 carries the locking assembly 30 in the form of a pair of gates 42 that are hinged, as at 43, to be movable from an open container assemblying position (FIG. 12) to a closed container confining position (FIG. 11). The closure locking means 30 comprise a vertical female slot 45 on one side and a complementary male tang or tongue 46 on the other side. Opposed surfaces of the female and male members 45, 46 are provided with sawtooth locking serrations 47, 48 thereby providing a quick assembly of the dispensing cap D on the canister body, when the complementary bead 42 and groove 23 are oriented and squeezed together to advance the tongue 46 into the opposed slot 45 to interlock the serrations 47, 48 together and close the gates 42.

The front wall 31 of the dispensing cap D is provided with an elongated vertical discharge slot 49 for receiving the nozzle 28 outwardly projecting therethrough which keeps the actuator head and cap D oriented against relative rotation. In another form, the interior wall surface of the cap D may be constructed and arranged with bosses 50 or the like to slidably receive the dispenser body 27 in a fixed, non-rotational relationship orienting the nozzle 28 with the discharge slot 49. Thus, even if the discharge head D should be rotated to any position on the canister, the spray actuator nozzle 28 and actuating surface 29 will always be properly aligned with the discharge slot 49 and open rear access of the cap D.

It will now be apparent that one objective of the invention is to provide a dispensing cap D to shield the actuator device of an aerosol canister from accidental or inadvertent discharge. The dispensing cap D is secured to the canister C and has a fixed non-rotational relationship with the spray discharge nozzle 28, while recessing the actuating head surface 29 and yet permitting access for manual actuation by vertically depressing the actuator to open the internal discharge valve. Another feature of the invention is to assemble this structure as an integral part of the personal defense system S, which also includes the holstering jacket H and other security means W,K associated therewith.

Referring particularly to FIGS. 1, 13 and 14, the hoister or casing H of the present invention comprises a main body portion 55 which may be formed from a one-piece blank and has opposed first or front and second or rear body panels 56 and 57. These panels 56, 57 are preferably connected by a common folded bottom margin, but may be made as separate and discrete panel members as shown. The panels 56 and 57 are aligned and marginally stitched along the sides, at 58, and around the bottom, at 59 if necessary, to form a closed sleeve or pocket, generally at 60 in FIG. 13, having an open upper end 61 to accommodate insertion of the canister C with the dispensing head D projecting outwardly of the open end 61. In the preferred form shown in FIGS. 1 and 16, the top 61 of the holster body 55 is straight cut across to seat or abut against the base 39 of the dispensing cap D. It will be understood that the casing H may be made of leather, plastic or like flexible materials.

The casing H is provided with means for interlocking with the dispensing cap D to keep the system S assembled and the dispensing nozzle 28 and actuator 27 properly oriented at all times. Such means preferably comprises a strap 62 extending upwardly from one of the side panels (57), and being constructed to engage the dispensing cap D at its top wall or crown 36 (to be described) and have its outer free end 63 releasably attached in a suitable manner to the other side panel (56). Although various fastening means may be used, it is presently preferred to use an interlocking matted, closed loop, fiber system of the type marketed under the trademark VELCRO. Thus, one fiber mat or pad 64 is provided on the under side of the strap end 63 and a complementary fiber mat or pad 65 is provided on an upper end extension or mating strap 66 of the panel 56.

Referring now specifically to FIGS. 1–4, in the preferred embodiment the side margins 167 of the top crown T of the dispensing cap D are offset inwardly from the outer surface of the side walls 33, and the upper side portions thereof below the upper top wall 35 have elongated slots 168 to receive the strap 62 of the hoister H therethrough. The relative short offsets at 167 best accommodate the bending of the strap 62 for tightening it in locking condition. It may be noted that the lower top wall 37 is omitted in this embodiment as shown.

Referring to the second embodiment of FIGS. 5 and 6, the crown T is shown as having a larger offset, at 269, inwardly of the side walls 33 and it may be desirable to provide an upper top wall in the form of a thick boss 235 with the slot 268 extending therethrough so that the strap (62) will be contained and not exposed to the open interior 38 of the dispensing cap D.

Referring again to FIGS. 7–14, the top wall T of this third embodiment is similar to that of FIG. 1 except the side margins 367 of the upper top wall 35 extend fully to the plane of the side walls 33 and the slots 368 are formed at the upper end of these side walls between the upper top defining wall 35 and the inner or lower wall 37 so that the holster strap 62 is fully confined.

With reference to FIGS. 15 and 16, in this embodiment the upper top wall 435 of the dispensing cap D is depressed to define a laterally extending groove 470 across the dispensing cap D between the opposed side walls 33. Thus, the front and rear margins of the top wall 435 are defined by upstanding shoulders 471 and 472 along the sloping front wall section 32 and short rear wall 36.

From the foregoing it will be understood that several alternative means are provided for interlocking the holstering casing H with the dispensing cap D to maintain the spray nozzle 38 and its actuator 29 in properly oriented position against rotation of the dispensing head D in the casing H. Therefore, the protective spray device of the present invention is always armed for immediate use when needed. As shown in FIG. 1, an additional feature that assists in the proper oriented usage of the system S, particularly at night, is the provision of a finger grip 80 in the form of two arcuate tabs 81 on the holster H and projecting forwardly below the front wall 31 of the dispensing cap D below the nozzle 28. The tabs 81 are spaced apart to accommodate the placement of three fingers by the user. In this way the holster casing H is always held or manually oriented in the proper position for use without having to visually inspect the dispensing nozzle position.

Referring again to FIGS. 1, 13 and 14, an important feature of the invention is to provide a personal defense system S designed to encourage preparedness and daily use, rather than be left in some place that is inaccessible or awkward in the event defensive action is needed. The defense system S of the present invention contemplates its usage with car and/or house keys K as an integral part of the security and defense system and the jacketed protective spray container thus becomes a keyholder and should always be available and at hand. According to statistics of the Criminal Justice Association, 70 percent of attacks occur within 150 yards of the home or office door or within 10–15 feet of the car. This is usually a time when the house or car keys are normally at hand for use.

The security system of the present invention assures that the protective spray can be employed even during the time the car or house key K is actually being used to gain access to the safety of the car or house. The holstering casing H is provided with a pull-away or quick release tab 90 releasably fastened to a side panel 56, 57 of the casing. The side wall 56 is shown with a matted interlocking fiber pad 91 of the type already discussed, and a cooperating matted fiber pad 92 is provided on the pull tab 90. One of the pads (92) is formed in two sections spaced apart by an open strip 93 which produces a stronger or more secure interlocking attachment between the pads 91 and 92. This is because separate bonding or interlocking exists between the dual pads 92 and the holster pad 91 and they cannot be simply released in one continuous action without extra effort. The tab 90 is provided with a grommet 95 for the attachment of a keyring 96 or the like for the key or keys K. The security means of the invention includes an audible signaling device, such as a whistle W, carried on the keyring 96.

It is important to note that the defense system S fully accommodates usage of key K or whistle W independently of the protective spray device operation so that the user can audibly signal for assistance or gain safe entrance into a car or house while fending off an attacker. As shown in FIGS. 1, 13 and 14, the base portion 97 of the holster H below the pull-away tab 90 has a row of stitching 98 or the like so that the flattened lower base 97 forms a second pull tab for use in cooperation with the security system tab 90. Thus, even if the key K has actually been inserted into the door lock (car or house) when the victim is very vulnerable to attack, the holster tab 97 can quickly be used to detach the holstered protective spray from the key tab 90 for defensive use.

The embodiments of the personal defense system are given by way of example for disclosure purposes, and the invention is only to be limited by the scope of the following claims.

What is claimed is:

1. A personal defense system comprising:

a protective spray container with a spray actuator on its upper end, said spray actuator including dispensing valve and nozzle means, and actuator control means operatively associated with said valve means;

a dispensing cap constructed and arranged to engage the upper end of the container and house the spray actuator and actuator control means thereunder, said cap having a front wall with a discharge opening operatively associated with the nozzle means and said actuator control means being recessed within the cap and manually accessible from the rear side opposite to the front wall; and a holster casing having a body portion with an open upper end for receiving the container with the dispensing cap projecting outwardly from the open upper end to thereby expose the front discharge opening of the dispensing cap and the actuator control means for the dispensing valve means, and locking means for orienting the dispensing cap in substantially fixed non-rotational relation within the casing.

2. The defense system of claim 1, in which said locking means comprises first means associated with the casing and second means associated with said dispensing cap, the second means being constructed and arranged for engagement by the first means for holding said cap against rotational movement relative to the casing.

3. The defense system of claim 2, in which said first means comprises a strap, and the second means includes other means on at least one wall of said dispensing cap to receive and be engaged by the strap.

4. The defense system of claim 3, in which said other means comprises a slotted passageway formed through the dispensing cap in association with said one wall thereof and said strap extends through said slotted passageway.

5. The defense system of claim 4, in which said one wall comprises upper wall means disposed above the spray actuator and in part defining the housing therefor, and said other means extends across the upper wall means transversely to the direction of orientation of the nozzle and actuator control means.

6. The defense system of claim 5, in which said dispensing cap includes opposed side walls extending rearwardly from the front wall below the upper wall means, and said slotted passageway being formed in said side walls immediately adjacent to the upper wall means.

7. The defense system of claim 6, in which the lateral marginal edges of said upper wall means are positioned above and offset inwardly of said side walls to define a vertical reach accommodating said slotted passageway.

8. The defense system of claim 5, in which said upper wall means comprises a top-forming upper wall and a lower upper wall in spaced relation and defining a through passageway that comprises the slotted passageway.

9. The defense system of claim 4, in which the slotted passageway is formed through said one wall of said dispensing cap.

10. The defense system of claim 3, in which said locking means further comprises third means for releasably securing the strap in cap orienting position relative to the casing body portion.

11. The defense system of claim 10, in which said releasable securing means comprises an interlocking fiber fastening system.

12. The defense system of claim 3, in which said other means comprises a strap receiving groove formed on an exterior surface of said one wall of said dispensing cap.

13. The defense system of claim 12, in which the strap receiving groove is defined by upstanding shoulders formed on opposed sides of the cap, and said strap extends across said one wall of said cap and is disposed in the groove between said upstanding shoulders.

14. The defense system of claim 1, in which the dispensing cap has a container engaging base including closure means for interlocking the cap on the container upper end to orient and hood the spray actuator and actuator control means in a predetermined position therein.

15. The defense system of claim 14, in which the predetermined position is defined by complementary groove means on one of said cap and container and mating bead means on the other of said cap and container.

16. The defense system of claim 15, in which the groove means is formed on the exterior of the container adjacent to its upper end, and the bead means is formed on the interior of the container engaging base, and said closure means has an open position for orienting the cap bead means in the container groove means.

17. The defense system of claim 16, in which said closure means on said container engaging base includes gate means having cooperative male an female members adapted for interfitting engagement from the open position to effect closure of the container engaging base upon the container, and interlocking means on the male and female members for securing the cap in fixed closed position.

18. The defense system of claim 1, and further comprising security means constructed and arranged for releasable attachment to the casing, including holding means for said security means, and first and second cooperable releasable fastening means on said casing body portion and said holding means, respectively.

19. The defense system of claim 18, in which said first and second releasable fastening means comprise interlocking matted fiber pads.

20. The defense system of claim 19, in which one of said matted fiber pads is formed in two spaced apart sections.

21. The defense system of claim 18, in which said first and second fastening means comprise first tab means associated with the casing body portion, and second tab means associated with said holding means for cooperation with said first tab means, said second tab means being adapted for rapid manual detachment from said first tab means to effect separation between said casing and holding means to accommodate independent and simultaneous use of both.

22. The defense system of claim 18, in which said security means includes key holding means.

23. The defense system of claim 18, in which said security means includes audible signaling means.

24. The defense system of claim 1, in which the holster casing includes hand grip means in the form of at least two projecting spaced tabs on the front margin of the casing for manually orienting the dispensing nozzle means and actuator control means for use.

25. A personal defense system comprising:

a protective spray container with a spray actuator on its upper end, said spray actuator including dispensing nozzle and an actuator control for dispensing a spray through the nozzle;

a dispensing cap engaged on the upper end of the container and housing the spray actuator, said cap having a front discharge opening associated with the nozzle and the actuator control being recessed within the cap and being manually accessible from the rear side opposite to said front opening; and a holster casing having a body portion with an open upper end for receiving the container with the dispensing cap projecting outwardly from the open upper end to orient the opposed front discharge opening and actuator control, and locking means for holding the dispensing cap against rotational movement relative to the casing body portion including a strap on the casing body and strap receiving means on said dispensing cap; and security means constructed and arranged for cooperable associated with the holster casing including holding means releasably attached to said casing body portion.

26. The defense system of claim 25, in which said holding means and casing body portion include first and second releasable fastening means comprising interlocking matted fiber pads.

27. The defense system of claim 26, in which one of said matted fiber pads is formed in two spaced apart sections.

28. A personal defense system comprising:

a protective spray container with a spray actuator on its upper end, said spray actuator including dispensing valve and nozzle means, and actuator control means for operating the valve means to dispense a spray through the nozzle means;

a dispensing cap constructed and arranged to engage the upper end of the container and house the spray actuator, said cap having a front wall with a discharge opening operatively associated with the nozzle means and said actuator control means being recessed within the cap and being manually accessible from the rear side opposite to said front opening;

a holster casing having a body portion with an open upper end for receiving the container with the dispensing cap projecting outwardly from the open upper end to thereby expose the opposed front discharge opening and actuator control means, and locking means for holding the dispensing cap against rotational movement relative to the casing body portion, said locking means including first casing means comprising a strap, and second cap means including a wall having slot forming means to receive and be engaged by the casing strap; and security means constructed and arranged for releasable attachment to the casing including a security holding tab, and first and second cooperable and releasable fastening means on said casing body portion and said holding tab.

29. The defense system of claim 28, in which said security means comprises key holding means for accommodating daily usage, and other tab holding means on the casing body portion adapted for cooperable action with the security holding tab to accommodate simultaneous usage of the security means and the protective spray container.

30. A personal defense system comprising:

primarily security means in the form of a protective spray canister having a spray actuator on its upper end, said spray actuator including dispensing valve and nozzle means, and actuator control means associated with said valve means for dispensing the protective spray from the canister as a primary person defense;

a dispensing cap constructed and arranged to engage the upper end of the canister and house the spray actuator, said cap having a front wall with a discharge opening operatively associated with the nozzle means and said actuator control means being recessed within the cap and manually accessible from the side opposite to said front wall;

secondary security means in the form of manually operated means for selectively asserting a secondary personal defense; and other means interposed between and forming a releasable attachment of said canister and said secondary security means, said other means comprising holding means for said second security means, and first and second releasable fastening means constructed and arranged to accommodate the separation of said holding means of the secondary security means from said canister.

31. The defense system of claim 30, in which first said releasable fastening means is associated with said canister and said second fastening means is associated with said holding means of the secondary security means.

32. The defense system of claim 31, in which said first and second fastening means comprise interlocking hook and loop pads.

33. The defense system of claim 32, in which said first fastening means includes a holster casing for interiorly housing said canister and having one of the hook and loop pads mounted exteriorly thereof.

34. The defense system of claim 30, in which said first and second releasable fastening means normally hold the primary and secondary security means in assembled relationship.

35. A tear gas defense system comprising:

a tear gas spray canister with a spray actuator on its upper end, said spray actuator including dispensing valve and nozzle means, and actuator control means operatively associated with said valve means for dispensing a protective spray from the canister as a primary personal defense;

a dispensing cap constructed and arranged to engage the upper end of the canister and house the spray actuator and actuator control means thereunder, said cap having a front wall with a discharge opening operatively associated with the nozzle means and said actuator control means being recessed within the cap and manually accessible from the side opposite to said front wall; and said dispensing cap having a canister engaging base including closure means for securely interlocking the cap on the canister end to orient and hood the spray actuator and actuator control means in a predetermined position therein.

36. The defense system of claim 35, in which the predetermined position is defined by complementary groove means on one of said cap and canister and mating bead means on the other of said cap and canister.

37. The defense system of claim 36, in which the groove means is formed on the exterior of the canister adjacent to its upper end, and the bead means is formed on the interior of the cap base, and said closure means has an open position for accommodating assembly of the cap bead means in the canister groove means, and means for securing the closure means in a fixed closed position.

38. The defense system of claim 35, which includes secondary security means in the form of manually operated means for selectively asserting a secondary personal defense, and first and second releasable fastening means constructed and arranged for normally attaching said secondary security means to said spray canister and being adapted to accommodate the rapid separation thereof to accommodate independent simultaneous usage of the spray canister and said secondary security means.

* * * * *

UNITED STATES PATENT AND TRADEMARK OFFICE

CERTIFICATE OF CORRECTION

PATENT NO. : 5,287,995

DATED : February 22, 1994

INVENTOR(S) : Kenneth R. Redman and Randall D. Lytle

It is certified that error appears in the above-identified patent and that said Letters Patent is hereby corrected as shown below:

Column 2, line 13, "hoister" should be --holster--.

Column 5, lines 24 and 64, "hoister" should be --holster--.

Signed and Sealed this

Twenty-seventh Day of September, 1994

*Attest:*

Bruce Lehman

BRUCE LEHMAN

*Attesting Officer*

*Commissioner of Patents and Trademarks*